US006004723A

United States Patent [19]

Figov

[11] Patent Number: 6,004,723

[45] Date of Patent: Dec. 21, 1999

[54] IR ABLATEABLE DRIOGRAPHIC PRINTING PLATES AND METHODS FOR MAKING SAME

[75] Inventor: Murray Figov, Ra'anana, Israel

[73] Assignee: Scitex Corporatrion Ltd., Herzlia, Israel

[21] Appl. No.: 08/981,507

[22] PCT Filed: Jun. 13, 1996

[86] PCT No.: PCT/IL96/00015

§ 371 Date: Dec. 12, 1997

§ 102(e) Date: Dec. 12, 1997

[87] PCT Pub. No.: WO97/00175

PCT Pub. Date: Jan. 3, 1997

[30] Foreign Application Priority Data

Jun. 13, 1995 [IL] Israel ..... 114137

[51] Int. Cl.[6] ..... G03C 1/76

[52] U.S. Cl. ..... 430/272.1; 430/271.1; 430/273.1; 430/278.1; 430/303; 430/944

[58] Field of Search ..... 430/272.1, 303, 430/273.1, 944, 278.1, 271.1

[56] References Cited

U.S. PATENT DOCUMENTS

| | | | |
|---|---|---|---|
| 3,907,562 | 9/1975 | Crystal | 96/1.8 |
| 3,961,947 | 6/1976 | Wells . | |
| 4,588,674 | 5/1986 | Stewart et al. . | |
| 5,310,869 | 5/1994 | Lewis et al. . | |
| 5,339,737 | 8/1994 | Lewis et al. | 101/454 |
| 5,378,580 | 1/1995 | Leenders | 430/303 |
| 5,493,971 | 2/1996 | Lewis et al. . | |

FOREIGN PATENT DOCUMENTS

| | | |
|---|---|---|
| 1050805 | 3/1979 | Canada . |
| WO 94/01280 | 1/1994 | WIPO . |

*Primary Examiner*—Janet Batier
*Assistant Examiner*—Barbara Gilmore
*Attorney, Agent, or Firm*—Darby & Darby

[57] ABSTRACT

There is disclosed an IR ablateable driographic printing plate (10) including a substrate (12), an IR absorbing layer (14) comprised substantially of a first water based emulsion and a top IR ablatable layer (16) comprised substantially of a second water based emulsion. The term water based is used herein to indicate the precursor materials from which each layer is being deposited are dissolvable in water and not in an organic solvent or solvents.

13 Claims, 2 Drawing Sheets

IR ABLATEABLE DRIOGRAPHIC PRINTING PLATES AND METHODS FOR MAKING SAME

FIELD OF THE INVENTION

The present invention relates to Infra Red (IR) ablateable driographic printing plates generally, and more particularly to IR ablateable driographic printing plates comprised of water based coating layers and methods for producing same.

BACKGROUND OF THE INVENTION

IR ablateable waterless offset printing plates, also termed IR ablateable driographic printing plates, are well known in the art. They typically include, in order, a substrate, e.g. a polyester film, an intermediate oleophilic Infra Red (IR) radiation absorbing layer and a top oleophobic layer.

Offset printing plates, including waterless offset printing plates are selectively exposed to radiation in order to expose a latent image thereon, the image subsequently is selectively colored during printing with oil based inks, typically the four process inks Cyan, Magenta, Yellow and Black (CMYK) inks.

In most IR sensitive driographic plates, the latent image is recorded by ablating the top oleophobic layer and therefore during printing, the oil based inks are repelled by the areas of the top oleophobic layer which have not been ablated during imaging and are not repelled by the oleophilic absorption layer and the substrate revealed in the ablated areas.

Typically, the top ablateable oleophobic layer is composed of silicone (polysiloxane) or a mixture of silicones cross-linked by cross-linking agents deposited on the plate from a solution dissolved in an organic solvent.

For example, naphtha was described as the solvent employed for producing the top ablateable oleophobic layer using one silicone composition in U.S. Pat. No. 5,378,580 to Leenders and using a mixture of silicone solutions with cross linking agents in U.S. Pat. No. 5,310,869 to Lewis et al.

In the prior art, the IR absorption layer of driographic printing plates have been also produced employing organic solvents. For example, published PCT application GB93/01413 to Gutes et al describes the use of a water-alcohol mixture, for producing the IR absorption layer.

Generally speaking, since organic solvents are used in preparing prior art driographic printing plates, the plates are not environmentally friendly.

SUMMARY OF THE INVENTION

An object of the present invention is to provide a waterless Infra Red (IR) ablateable offset printing plate which is produced substantially without using organic solvents.

According to a preferred embodiment of the present invention, the plate is comprised from a substrate coated, in order, by two layers, a water based oleophilic IR absorption layer and a water based IR ablateable oleophobic layer.

According to a second preferred embodiment of the present invention, the plate includes a substrate coated, in order, by three layers, a water based adhesion promoting layer, a water based IR oleophilic layer and a water based IR ablateable oleophobic layer.

The term water based is used herein to indicate that the precursors materials from which each layer is being deposited are dissolved in water and not in an organic solvent or solvents.

According to one aspect of the present invention, water is employed with silicone emulsions and cross-linking agents to produce the top oleophobic layer.

An emulsion as used herein refers to a water insoluble resin substantially homogeneously dispersed in water.

According to another aspect of the present invention, water is employed with suitable resins and suitable IR absorbing materials to produce the IR absorbing oleophilic layer.

According to a further aspect of the present invention, water is employed with suitable resins to produce the adhesion promoting layer.

An advantage of the plates of the present invention is that they are water based and therefore, they are more environmentally friendly than prior art IR ablateable driographic plates.

There is thus provided, according to a preferred embodiment of the present invention, an IR ablateable driographic printing plate comprising, in order a substrate, an IR absorbing layer comprised substantially of a first water based emulsion, and a top IR ablateable layer comprised substantially of a second water based emulsion.

Further, according to a preferred embodiment of the present invention, the plate may also include an adhesion promoting layer between the substrate and the IR absorbing layer, the adhesion promoting layer is comprised substantially from a third water based emulsion.

According to a preferred embodiment of the present invention, the first water based emulsion is selected from the group consisting of acrylic emulsions, urethane emulsions, vinylidene chloride emulsions and polyester emulsions.

Further, the second water based emulsion is selected from the group consisting of silicone emulsions and a mixture of silicone emulsions and a cross linking reagent.

Still further, the third water based emulsion is comprised substantially from aliphatic aqueous colloidal solution dispersion of a urethane polymer.

Preferably, the thickness of each of the adhesion promoting layer, IR absorbing layer and the IR ablateable layer ranges between 0.5 and 5 grams per square meter.

According to a preferred embodiment of the present invention, the IR ablateable layer is oleophobic, the adhesion promoting layer, the IR absorbing layer and the substrate are oleophilic and the substrate is selected from the group consisting of polyester, aluminum, polyamide and polycarbonate.

There is also provided, according to a preferred embodiment of the present invention, an IR ablateable driographic printing plate comprising, in order, a substrate, an IR absorbing layer and a top IR ablateable layer, the improvement comprising a top IR ablateable layer comprised substantially of a water based emulsion. The water based emulsion is preferably selected from the group consisting of silicone emulsions and a mixture of silicone emulsions and a cross linking reagent.

There is also provided, according to a preferred embodiment of the present invention, an IR ablateable driographic printing plate comprising a substrate, an IR absorbing layer and a top IR ablateable layer, the improvement comprising an IR absorbing layer comprised substantially of a water based resin.

Further, the plate may include an adhesion promoting layer between the substrate and the IR absorbing layer, the adhesion promoting layer is comprised substantially from a water based emulsion. Preferably, the IR absorbing emulsion is selected from the group consisting of acrylic emulsions, urethane emulsions, vinylidene chloride emulsions and polyester emulsions.

Finally, there is also provided, according to a preferred method of the present invention, a method for producing an IR ablateable driographic printing plate comprising, in order, the steps of coating a substrate with a first water based emulsion, drying the first water based emulsion, whereby an IR absorbing layer over the substrate is obtained, coating the IR absorbing layer with a second water based emulsion and drying the second emulsion whereby an IR ablateable layer over the IR absorbing layer is obtained. The method may also include the step of coating the substrate with a water based adhesion promoting emulsion and drying it before the coating and drying of the IR absorbing layer.

BRIEF DESCRIPTION OF THE DRAWINGS

The present invention will be understood and appreciated more fully from the following detailed description taken in conjunction with the drawings in which.

DETAILED DESCRIPTION OF THE PREFERRED EMBODIMENTS

Figure 1:
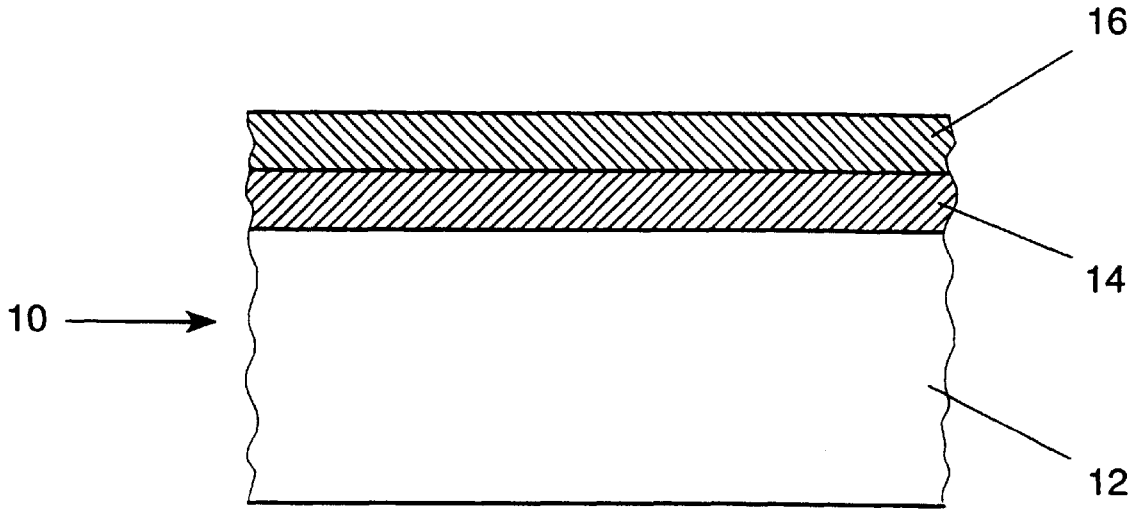
FIG. 1 is a schematic cross section illustration of a driographic offset printing plate, constructed according to a preferred embodiment of the present invention.
Figure 2:
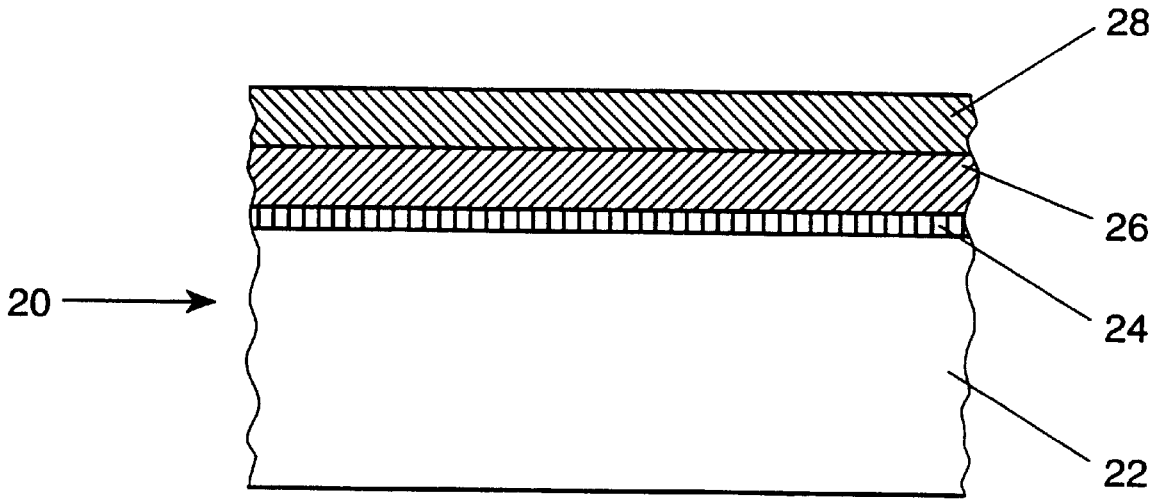
FIG. 2 is a schematic cross section illustration of a driographic offset printing plate, constructed according to a second preferred embodiment of the present invention.

Reference is now made to FIGS. 1 and 2 which illustrate a three layer driographic offset printing plate and a four layer driographic offset printing plate respectively, constructed according to two preferred embodiments of the present invention.

The plate of FIG. 1, generally referenced 10, comprises a substrate 12, such as a polyester film, an IR absorbing layer 14 and a top IR ablateable oleophobic layer 16.

The plate of FIG. 2, generally referenced 20, comprises a substrate 22, an adhesion promoting layer 24 coated thereon, an IR absorbing layer 26 and a top IR ablateable oleophobic layer 28.

According to the present invention, water and not an organic solvent is employed in the production of the IR absorbing layer 14 and the IR ablateable oleophobic layer 16 of the plate 10 as well as the adhesion promoting layer 24, the IR absorbing layer 26 and the top ablateable oleophobic layer 28.

According to a preferred embodiment of the present invention, the top oleophobic layers 16 (FIG. 1) and 28 (FIG. 2) are composed from an aqueous emulsion of silicones mixed with suitable cross-linking reagents. Examples of suitable aqueous silicone emulsions may be prepared from the following resins: VP 4350 which is a methyl silicone emulsion, VP 4302 which is a medium hard methyl-phenyl silicone resin and Dehesive 410E, all commercially available from Wacker Silicones of Adrian Mich., U.S.A, Silikophen; P40/W which is a phenyl methyl polysiloxane, commercially available from Tego Chemie Service Hopewell, Va., U.S.A.; R20-UCC, commercially available from Union Carbide of Danbury, Conn., U.S.A.; Syloff 22 and Syloff 1170, commercially available from Dow Corning of Midland, Mich., U.S.A.; SM2013 and SM 30XX commercially available form General Electric of Waterford, N.Y., U.S.A; and the PCXY silicone emulsion, commercially available from Rhone Poulenc of Louisville, Ky., U.S.A.

It will be appreciated that all the silicone emulsions described above are sold together with a suitable cross linking reagent or reagents.

According to another preferred embodiment of the present invention, the emulsion may also contain adhesion promoters, surfactants and small amounts of compatible resins or resin salts.

A preferred method for producing the top oleophobic ablateable layer includes the following steps:

A. mixing the silicone emulsion or emulsions with the corresponding cross-linking reagent or reagents; and B. Depositing and drying the mixture over a film to provide a coating having a thickness of between 0.5 and 5 grams per square meter (g.m.s.), a preferred range for employing the coated layer as an IR ablateable oleophobic layer for a driographic plate.

According to a preferred embodiment of the present invention, the IR absorbing layer 14 (FIG. 1) and 26 (FIG. 2) is comprised of any suitable water based emulsion prepared from resins selected from the group which includes acrylic resins, urethane resins, vinylidene chloride resins and polyester resins.

Examples of suitable acrylic resins are the Rhoplex B-60A, ACW8-6 and TAW4-11, commercially available from Dock Resins of Binder, N.J., U.S.A, Joncryl 77 and Hydro-Rez 2000, commercially available from Lawter International, Northbrook, Ill., U.S.A.

Examples of suitable urethane resins are the Bayhydrols B-130, 110, 121, 123 and 140AQ, commercially available from Miles of Pitsburg, Pa., U.S.A; Witcobond W-160, commercially available from Witco of Greenwich, Conn., U.S.A.; and Neorez R-9679 and Neorez 9699, commercially available from Zeneca of Wilmington, Mass., U.S.A.

Examples of suitable vinylidene chloride resins are the Serfene 2011 and 2018, commercially available from Morton International, Riverside Plaza, Chicago, Ill., U.S.A.

Examples of suitable polyester resins are the Eastman AQ 29D commercially available from Eastman Chemical Co. of Kingsport, Tenn., U.S.A., Hydro-Rez 100, commercially available form Lawter and Mirasol, and the 10-A-1516, commercially available from Osborn Mercantile of N.J., U.S.A.

The preferred method for producing the IR absorption layer includes the following steps:

Depositing a suitable water based resin emulsion directly on the substrate 12 (FIG. 1) or on the adhesion promoting layer 24 (FIG. 2); and drying the deposited resin to obtain the desired coated layer.

According to a preferred embodiment of the present invention, the adhesion promoting layer 24 is comprised from an aliphatic aqueous colloidal solution dispersion of urethane polymer, cross-linked to insolubilise it. Such a resin solution can be loaded with infra-red absorbing materials and used in the infra-red absorbing under-layer as well.

The preferred method for producing the adhesion promoting layer includes the following steps:

A. Depositing a suitable water based resin on the substrate 22; and drying the deposited layer to obtain the adhesion promoting coating.

The following examples describe by way of example certain aspects of the present invention without limiting its scope.

EXAMPLE I

This is an example illustrating the production of the plate 10.

The IR absorbing layer 14 was produced employing the following compositions:

The Neorez R-9679 (marketed by Zeneca Resins of Wilmington, Mass.), is an aliphatic aqueous colloidal dispersion of a urethane polymer—total solids by weight of 37%. Stantone 90WD01 is 32% carbon dispersed in an acrylic/water binder total solids approximately 45%. 100 parts by weight of Stantone 90WD01 was mixed with 50 parts by weight of Neorez 9679 and coated to a weight of 4.2 g.s.m. onto 125 micron polyester film and dried in an oven at 120° C. This yielded the IR absorbing coat 14 coated on a polyester substrate 12.

The ablateable oleophilic layer 16 was produced as follows:

76 RES 6038 is an aqueous solution of sodium polyacrylate with a total solids of 13.5%. This was diluted 1:1 with water and used in the following formulation (all parts in all the examples are by weight):

| | |
|---|---|
| Wacker Dehesive 410E | 10 parts |
| Water | 154 parts |
| Crosslinker V-20 (Wacker) | 1.5 parts |
| Diluted 6038 | 3 parts |
| Adhesive Promoter HF-86 (Wacker) | 1.5 parts |
| Q2-5211 Super wetting agent (Dow Corning) | 1.8 parts |

This was coated onto the IR absorbing layer 14 produced as described above to a thickness of 0.75 grams per square meter and dried in an oven at 120° C.

The resulting infra-red sensitive printing blank was imaged on an external drum system using a half a watt laser diode emitting at 870 nano meters. The resulting image was wiped with a dry cloth and the plate printed with Novaless SL 210 waterless ink marketed by K+E (BASF, Stuttgart, Germany). It gave clean background and sharp print. This imaging device was used in all the examples.

EXAMPLE II

This is an example illustrating the production of the plate 20.

The adhesion promoting layer 24 was produced as follows:

50 parts of Neorez 9679 were mixed with 1.1 parts of cross-linker CX-100, 2.5 parts of Ektasolve EP and 50 parts of water. This solution was coated to a weight of 1 g.s.m. onto a 120 g.s.m. polyester film 22 and dried in an oven at 120° C.

The IR absorbing layer 26 was produced employing the following compositions:

150 parts by weight of Stantone 90WD01 were mixed with 50 parts by weight of Rhoplex-60 and coated to a coating weight of 1.2 g.s.m. onto the adhesive promoting layer 22.

The same top layer of Example I was then coated to a weight of 2 g.s.m. to provide the top oleophobic IR ablateable layer 28.

The resulting blank was imaged and printed as in Example I giving printed impressions with clean background and sharp print.

EXAMPLE III

The adhesion promoting layer 24 and the IR absorbing layer 26 of Example II were used with the following top layer coat to provide an alternative example of the plate 20:

| | |
|---|---|
| PC-107 (Rhone Poulenc polymer) | 100 parts |
| PC-95 (Rhone Poulenc cross-linker | 10 parts |
| Water | 500 parts |

This coating was applied to a weight of 1.8 g.s.m. and dried at 120° C.
for 4 minutes. As in the previous Examples, the printing performance achieved was good.

EXAMPLE IV

This example illustrates yet another non limiting example of the plate 20.

The adhesive layer 24 was produced as follows:

50 parts of Jonacryl 77 (acrylic emulsion) were diluted with 60 parts of water and 1.9 parts of Cymel 373 and 2.5 parts of Ektasolve EP added. The emulsion was baconto 175 g.m. polyester film 22 to a weight of 2 g.s.m. and dried for 1 minute at 120° C.

The adhesion promoting layer 24 was then over coated with a 2 g.s.m. layer of an infra red absorbing dried film 26 deposited from an emulsion of the following formulation:

| | |
|---|---|
| Serfene 2011 | 50 parts |
| StanTone 90WD01 | 120 parts |
| Water | 15 parts |

This layer was also oven dried under the same conditions as the adhesion promoting layer.

The emulsion used for the IR ablateable oleophobic layer 28 used in this example was of the following composition:

| | |
|---|---|
| Syloff 7900 (polymer) | 10 parts |
| Syloff 7922 (cross-linker) | 10 parts |
| Water | 100 parts |

The coating weight was 2.5. g.s.m. and the resulting plate provided good imaging qualities.

It will be appreciated that the preferred embodiments described hereinabove are described by way of example only and that numerous modifications thereto, all of which fall within the scope of the present invention, exist. For example, while the invention is described with respect to a polyester substrate, any other suitable substrate, such as aluminum, polyamide and polycarbonate plates may be employed.

It will be appreciated by persons skilled in the art that the present invention is not limited to what has been particularly shown and described hereinabove. Rather, the scope of the present invention is defined only by the claims that follow:

I claim:

1. An IR ablateable driographic printing plate comprising:

a substrate;

an IR absorbing layer over said substrate, said IR absorbing layer comprised substantially of a first water based emulsion; and a IR ablateable layer over said IR absorbing layer, said IR ablatable layer comprised substantially of a second water based emulsion.

2. A plate according to claim 1 and also comprising an adhesion promoting layer between said substrate and said IR absorbing layer, said adhesion promoting layer is comprised substantially from a third water based emulsion.

3. A plate according to any of claims 1 or 2 wherein said first water based emulsion is selected from the group consisting of acrylic emulsions, urethane emulsions, vinylidene chloride emulsions and polyester emulsions.

4. A plate according to claim 1, wherein said second water based emulsion is selected from the group consisting of:

silicone emulsions, and a mixture of silicon emulsions and a cross linking reagent.

5. A plate according to claim 2 wherein said third water based emulsion is comprised substantially from aliphatic aqueous colloidal solution dispersion of a urethane polymer.

6. A plate according to claim 2 wherein the thickness of each of said adhesion promoting layer, IR absorbing layer and said IR ablateable layer ranges between 0.5 and 5 grams per square meter.

7. A plate according to claim 1 wherein said IR ablateable layer is oleophobic.

8. A plate according to claim 2 wherein said adhesion promoting layer, said IR absorbing layer and said substrate are oleophilic.

9. A plate according to claim 1 wherein said substrate is selected from the group consisting of polyester, aluminum, polyamide and polycarbonate.

10. In an IR ablateable driographic printing plate comprising, in order, a substrate, an IR absorbing layer and a top IR ablateable layer, the improvement comprising a top IR ablateable layer comprised substantially of a water based emulsion.

11. In a plate as in claim 10 wherein said water based emulsion is selected from the group consisting of silicone emulsions and a mixture of silicone emulsions and a cross linking reagent.

12. A method for producing an IR ablateable driographic printing plate comprising, in order:

coating a substrate with a first water based emulsion;

drying said first water based emulsion, whereby an IR absorbing layer over said substrate is obtained;

coating said IR absorbing layer with a second water based emulsion; and drying said second emulsion whereby an IR ablateable layer over said IR absorbing layer is obtained.

13. A method according to claim 12, further comprising coating said substrate with a water based adhesion promoting emulsion and drying it before said coating and of drying said IR absorbing layer.

* * * * *